US007049956B2

(12) United States Patent
Hughes, Jr. et al.

(10) Patent No.: US 7,049,956 B2
(45) Date of Patent: May 23, 2006

(54) METHOD AND APPARATUS FOR DISABLED ACCESS TO POLLING PLACES

(75) Inventors: Patrick H. Hughes, Jr., Evanston, IL (US); H. Hollister Rundy, IV, Northfield, IL (US)

(73) Assignee: Inclusion Solutions, LLC, Chicago, IL (US)

( * ) Notice: Subject to any disclaimer, the term of this patent is extended or adjusted under 35 U.S.C. 154(b) by 87 days.

(21) Appl. No.: 10/464,983

(22) Filed: Jun. 19, 2003

(65) Prior Publication Data

US 2004/0257221 A1 Dec. 23, 2004

(51) Int. Cl.
*G08B 1/08* (2006.01)

(52) U.S. Cl. ..... 340/539.11; 340/321; 340/328; 340/330; 340/573.1; 206/223; 235/51

(58) Field of Classification Search ..... 340/539.11, 340/573.1, 328, 330, 286.11, 321; 379/92.01; 455/403, 404.1; 206/216, 218, 223; 235/51; 52/36.1; 312/265, 249.1, 351.1, 351.3
See application file for complete search history.

(56) References Cited

U.S. PATENT DOCUMENTS

| | | | | | |
|---|---|---|---|---|---|
| 3,806,219 | A * | 4/1974 | Ahmann | 312/265 |
| 5,475,369 | A * | 12/1995 | Baker | 340/573.3 |
| 5,585,612 | A * | 12/1996 | Harp, Jr. | 235/51 |
| 5,657,380 | A * | 8/1997 | Mozer | 379/88.01 |
| 5,666,765 | A * | 9/1997 | Sarner et al. | 52/36.1 |
| 5,724,910 | A * | 3/1998 | Annesley et al. | 116/209 |
| 5,870,788 | A * | 2/1999 | Witkin | 14/69.5 |
| 5,886,631 | A * | 3/1999 | Ralph | 340/541 |
| 5,986,786 | A * | 11/1999 | Crandall et al. | 398/130 |
| 5,992,620 | A * | 11/1999 | Holtom | 206/232 |
| 6,618,582 | B1 * | 9/2003 | Coons et al. | 455/404.1 |
| 2002/0125167 | A1 | 9/2002 | Hughes, Jr. et al. | |

* cited by examiner

*Primary Examiner*—Davetta W. Goins
(74) *Attorney, Agent, or Firm*—Schiff Hardin LLP

(57) ABSTRACT

A portable kit for use at a polling place to ease access of a disabled person to voting facilities. The portable kit includes a case containing a base, a collapsible post for mounting on the base and an activation switch mountable on the post and having a radio transmitter for emitting a radio signal when operated by a disabled person. A sign is also provided on the post to alert the disabled person of the presence of the assistance. A radio receiver and loudspeaker is provided inside the polling place.

7 Claims, 3 Drawing Sheets

METHOD AND APPARATUS FOR DISABLED ACCESS TO POLLING PLACES

BACKGROUND OF THE INVENTION

1. Field of the Invention

The present invention is related generally to a method and apparatus for facilitating entry to polling places by persons with disabilities, and in particular to a kit and method for improving access to polling places for persons with disabilities.

2. Description of the Related Art

The right to vote is fundamental and guaranteed under the U.S. Constitution. Yet persons with disabilities have historically been a disenfranchised force in the American political system. For example, in the 2000 election, voters with disabilities voted at a lower participation rate than the general population, in large part because of their inability to physically enter many polling places.

Entrance into inaccessible polling locations is a primary concern for voters with disabilities. The U.S. General Accounting Office issued a report in October, 2001, that indicated that 84% of all polling locations had some barriers to accessibility for disabled voters. Typical among these barriers include curbs or steps which cannot be traversed, doorways which are too narrow for a wheelchair, and doors which a disabled voter may have difficulty opening unaided because they are too heavy or have inaccessible door hardware.

Another problem is that occasionally accessible entrances may be locked on election day, so that voters with disabilities cannot enter.

One alternative means of allowing voters with disabilities to participate has been "curbside voting." Many new voting machines are portable, and can be brought out to a voter who needs assistance. In this system, voters who arrive at an inaccessible polling have traditionally honked their horns, yell up, or sent someone inside to tell election officials that they need assistance so that officials can bring a ballot out to the front of the inaccessible facility or to the voter's vehicle. While this system is in place in 28% of all polling locations (of the 84% that are inaccessible), it has been ineffective to date as in many cases election officials do not hear horns or other requests for assistance, and voters are often left outside in hostile weather conditions.

Alternative solutions for voters with disabilities such as making them vote absentee ahead of time and changing their polling locations impose unreasonable burdens on these voters by making them vote at a time and place different than other citizens.

Election officials face unique challenges in making their polling places accessible. Polling locations such as churches, schools, and civic centers are normally not controlled, owned, or operated by election officials and are merely leased for election days every few years. Thus election officials have limited ability to impose access changes on facilities they do not control. Another problem is that there often are often a limited number of potential polling sites within a jurisdiction.

In November, 2002, President George W. Bush signed the "Help America Vote Act", which requires that polling places be made accessible to voters with disabilities in terms of entrances, exits, paths of travel, and other areas prior to the 2006 presidential election. The legislation allocates $100 million for this purpose. While this amount may sound impressive, it amounts to less than $500 for each of the inaccessible polling locations in the United States. Permanent accessibility changes to polling locations such as automated power doors, permanent ramps, or changing polling locations are cost prohibitive—and should just a small percentage of polling places spend such amounts, there will not be enough funds to solve access issues at all of a county or election district's polling places.

Thus, there is a desperate need for portable and affordable solutions to make polling places more accessible for voters with disabilities.

SUMMARY OF THE INVENTION

The present invention provides a method for enabling access for persons with disabilities to polling locations so that either the person can enter the polling location to cast a vote or so that election officials can bring a voting machine to the voter outside so that he or she can vote.

The present apparatus, provided in kit form, provides the materials and information needed by election officials and election judges to temporarily make changes to a polling place so that the facility is adequately accessible for voters with disabilities as required by the 2002 Help America Vote Act, the 1984 Voting for the Elderly and Handicapped Act and the 1990 Americans With Disabilities Act.

The present invention also includes a method for increasing access to polling places and to the American electoral system for voters with disabilities.

According to the present invention, a kit is provided for sale to state and local election officials. The kit includes information and equipment to assist election officials and election day judges with becoming more accessible to voters with disabilities.

The kit includes an oversized wireless alert system (bell) which will be mounted outside of the polling location; signage that indicates that voters should ring for voting assistance; a collapsible telescoping pole and base which can be set up to mount the bell on; additional signage; and instructions for use of the kit and for making other areas of a polling place more accessible.

Election officials are increasingly aware of their obligations to become accessible to voters with disabilities under various federal legislation and understand that in upcoming years they will be required to improve the accessibility of their polling places for voters with disabilities. Election officials are also interested in resolving the situation in a manner that is cost-effective for them and in a way that allows the election officials to directly address the issues of accessibility rather than turning over the responsibility to independent polling sites that may or not meet their obligations.

Election officials will be able to purchase the present kit through channels including, but not limited to, direct purchases from the manufacturer and election supply companies. The kit assists election officials as well as election-day judges ("election judges") to understand the issues relating to access for disabled voters and provides the equipment and information needed to make their polling places more accessible. Access is improved as required by law and done so in a dignified and affordable way.

The present invention also relates to a method of increasing access by persons with disabilities to polling places and a method of providing access equipment to election officials for use at polling places.

The first mentioned method includes the steps of providing signs, mounting posts, materials, notification devices, and other equipment and information so that persons with disabilities have increased access to voting by either assisted entry into polling place or having ballots brought out to them. The second mentioned method of providing equipment and information to election officials includes providing the equipment and information in a kit and marketing the kit to election officials. A further aspect of the method is that the commercial unit may include an order form for election officials to separately order an access ramp or other equipment.

DETAILED DESCRIPTION OF THE PREFERRED EMBODIMENTS

Figure 1:
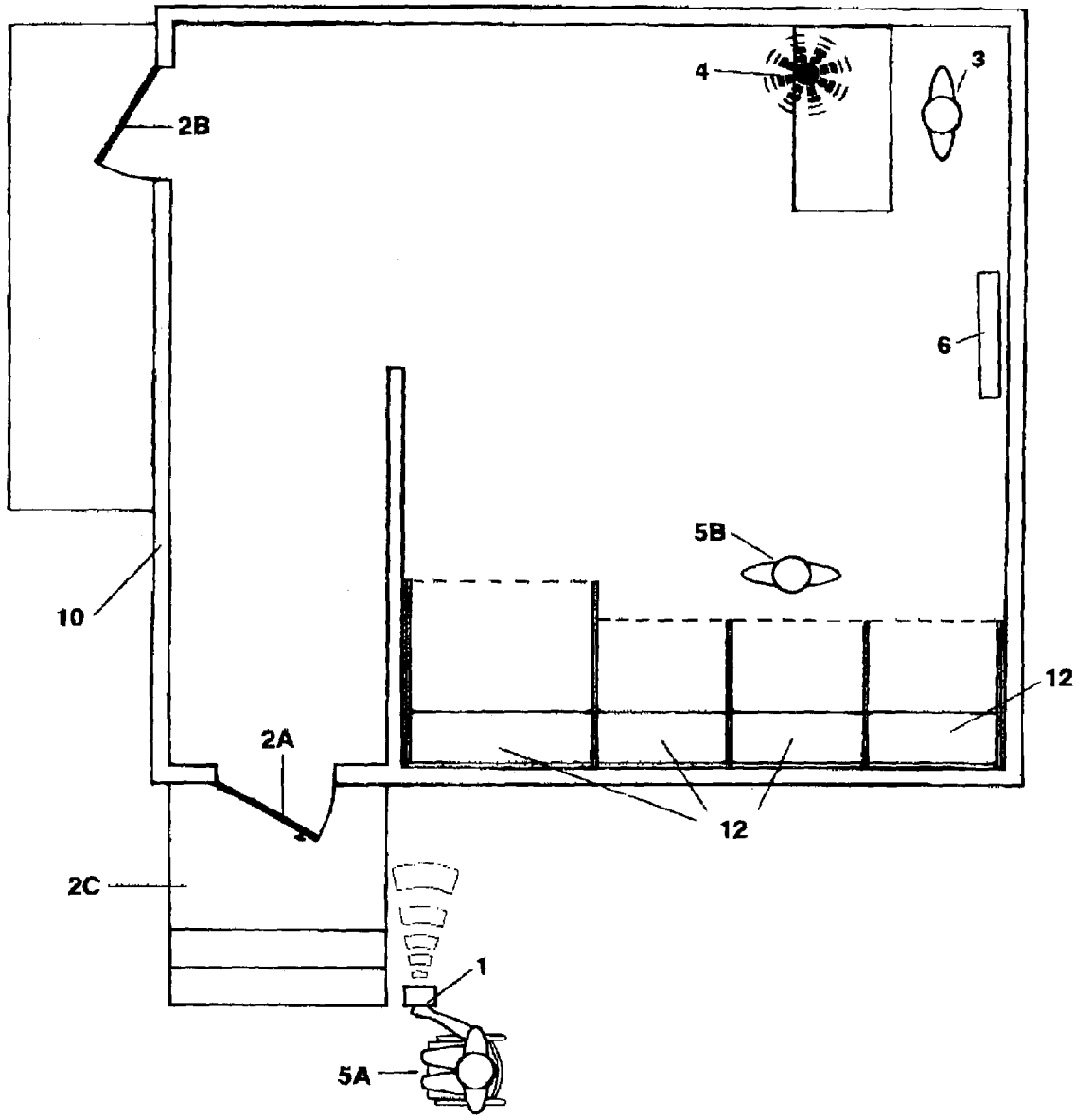
FIG. 1 is a plan view of a polling place including access equipment according to the present invention.

Referring first to FIG. 1, a polling place 10, or at least a portion thereof, is shown as a floor plan or plan view. The polling place 10 may be provided at a community center, school, city hall, municipal center, church, house, business, or other building. The polling place 10 as shown in the Figure may be a stand alone building or may indicate only a portion of a larger building. For purposes of the present invention, the polling place as shown is in some way inaccessible to at least some persons with disabilities. For example, the polling place 10 may have an entry with heavy or inaccessible doors 2. In addition, the polling place 10 may have steps 2C at the entry. A disabled voter 5A is attempting to enter the polling place 10 so as to join other voters 5B at the voting booths 12. An election official 3 is inside of the polling place 10.

For purposes of the present invention, the polling place 10 facility may be any structure or entrance, whether the entrance is to the outside or within a building, so long as it is being used as a polling location on election day. The polling place 10 may be inaccessible to the disabled person for a variety of reasons. For example, the polling place entrance may have heavy or inaccessible door hardware 2A that persons with disabilities may have difficulty opening. The polling place may also have an alternative accessible entrance 2B that has a ramp or other accessible means of entry. The polling place may have short steps 2C, up to 8 inches in height, that may be traversed by a portable ramp 6. Or, the polling place may have a fully inaccessible entrance 2D with either narrow doors or steps higher than 8 inches 2D that requires alternative voting.

The entrance 2A has been provided with equipment to increase access by persons with disabilities.

The entrance includes an easily activated alert system switch or bell 1 linked wirelessly to a receiver 4 inside the building, and a sign is associated with the alert system 1 indicating that voter 5A should ring for assistance. In a further embodiment, the equipment may also include a removable ramp over a step 2C at the entrance.

In the first scenario relating to the entrance 2A, the polling place 10 has a heavy or inaccessible door, and the disabled voter 5A activates the alert system 1 to request assistance with entry into the polling place. The election official 3 can then come and assist the voter 5A with the heavy or inaccessible door 2A.

In the second scenario relating to the entrance 2B, the polling place 10 has an alternative accessible entrance 2B which is not the main voter entrance 2A or which may be locked. The disabled voter 5A activates the alert system 1 to request assistance getting to, finding, or entering the polling place at the alternative accessible entrance. The election official 3 can come out to assist the voter 5A by escorting him or her to and through the accessible entrance 2B.

In the third scenario relating to the steps 2C, the polling place has steps 2C that may each be up to 8 inches in height. The disabled voter 5A activates the alert system 1 and the election official 3 brings out a portable ramp 6 to allow the voter 5A entry to the polling place 10. The ramp 6 is shown in the stored position in the Figure. The ramp 6 of the present invention provides access over curbs and steps for wheelchairs, scooters, and baby strollers of all types. The ramp 6 is portable and can therefore be put into place when needed and removed at other times. It can also be moved to other doorways, steps and curbs as the need arises. Election officials who do not need a ramp may purchase the present kit without it.

In the fourth scenario relating to the steps and/or entrance 2D, the polling place has a one or more steps 2D of over 8 inches in height which are too high for the voter to traverse, even using a portable ramp, or the entrance doorway may be less than 32 inches wide preventing passage of the voter's wheelchair, or some other barrier may be present that prevents the disabled voter 5A from entry. At these locations, curbside voting may be available. The disabled voter 5A activates the alert system 1 and the election official 3 brings out the ballot to the voter 5A, who votes outside of the inaccessible polling place 10.

Prior to installation of the equipment according to the present invention, a person encountering the entrance 2A, 2B or 2C in a wheelchair or who is otherwise unable to traverse a step and/or open a door would be unable to enter the building or may do so only with considerable difficulty. Election judges 3 at the polling location 10 are able to set up and install the present access kit to improve accessibility at entrances 2A, 2B or 2C that may otherwise present a barrier to a person who uses a wheelchair, scooter or walker. Election officials are able to purchase the kit and deliver it, packed in a suitcase (refer to FIG. 3), to election judges 3 on election day.

Figure 2A:
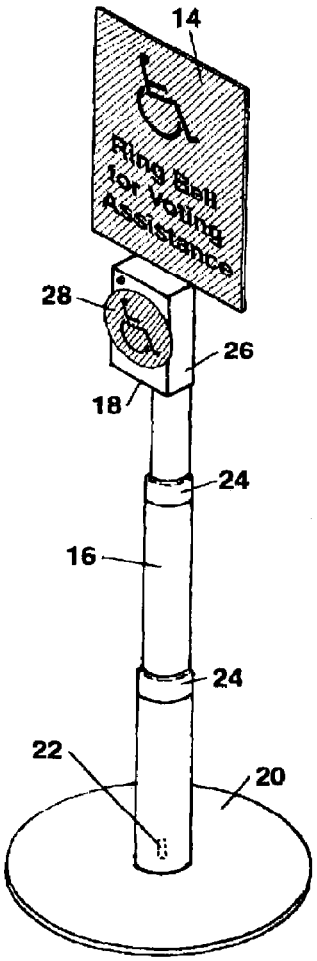
FIG. 2A is a perspective view of an alert transmitter and sign apparatus of the present kit.

Referring to FIG. 2A, the alert system 1 of FIG. 1 is shown in greater detail. It includes a sign 14 and signpost 16 and an activator switch 18 mounted on the signpost 16. In particular, the activator switch 18 is mounted onto a bracket (which extends behind the sign 14 in this view) which attaches to a telescoping metallic pole 16 mounted onto a base 20. The assembled activator 18 and signpost 16 is placed at or near the entrance of the polling location 10. Not only is the location of the switch 18 important, but the height of the switch 18 must be such that it can be reached by persons in wheelchairs, such as at a height of 36 inches from the floor or ground. The telescoping signpost 16 is adjustable in height to position the switch 18 at a convenient position and to collapse the signpost 16 for storage. The signpost 16 is also removable from the base 20 for more convenient storage and transportation. For example, the base 20 may have a threaded bolt 22 extending upward at it's center and the signpost 16 threads onto the bolt and is thereby easily assembled and disassembled. The signpost 16 has telescoping sections with twist-lock fasteners 24 at each section.

The activator switch 18 has a housing 26 enclosing a radio transmitter circuit and battery power supply. On the housing 26 is a large activation button 28 which is operated to cause the radio transmitter circuit to emit a signal.

Figure 2B:
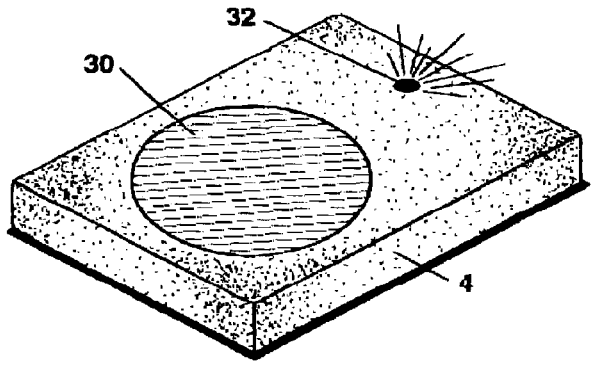
FIG. 2B is a perspective view of an alert system receiver of the present access kit.

The receiver 4 for the alert system is shown in FIG. 2B, including a housing 30 enclosing a radio receiver circuit and a light 32 which illuminates when a signal is received from the radio transmitter in the activator switch 18. The receiver unit 4 has a speaker for emitting an audible sound when the activator switch 18 is pressed by the disabled person seeking assistance.

Figure 3:
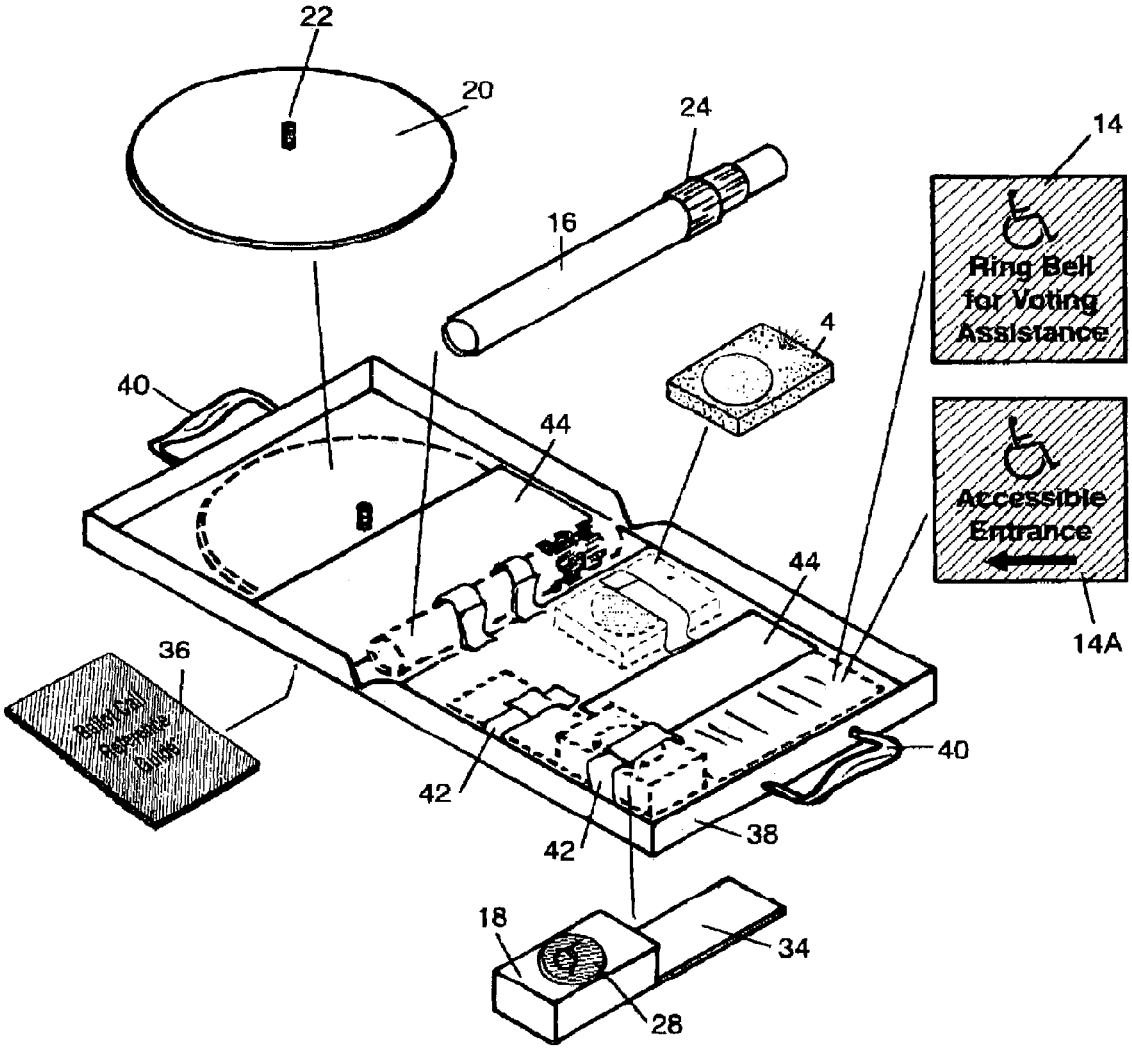
FIG. 3 is an exploded view of the alert system kit showing each of the components removed from the kit and indicating the position of the components in the carrying case of the kit.

Referring to FIG. 3, the present invention provides that the access equipment is offered in a kit. One such kit is sold to election officials as a commercial unit that includes the activator switch 18 attached to a mounting bracket 34, the receiver 4, signs 14, the base 20, the telescoping mounting post 16, and a reference guide 36 that includes instructions for assembly as well as guidelines for additional accessibility 18. The components are packed in a carrying case 38. The carrying case 38 has handles 40 and straps 42 and pockets 44 for holding each of the components in position.

In a preferred embodiment, the activator switch 18 has a button 28 that is relatively large and requires minimal pressure to activate. In one embodiment, the activator switch button 28 is round, approximately three inches (7.5 cm) in diameter, and marked with the international symbol for accessibility. Because the activator switch 18 may be mounted outside, it has a weather-resistant cover 26. The size and format of the activator switch 18 permits a person with limited manual dexterity to activate it with a fist an elbow or a head, for example, rather than a finger. The activator switch button 28 can also be triggered by a cane or other implement.

The activator switch 18 has a battery power supply and a radio transmitter. The radio transmitter preferably operates on an industry-standard frequency which is picked up by the receiver 4. The receiver 4 will activate by sounding a tone and/or activating the flashing light 32, so that persons in a loud environment or with hearing impairments may be alerted. The activator switch 18 and receiver 4 may be plugged into a standard AC wall socket. In an alternative embodiment, the receiver unit 4 may be instead battery-operated.

The radio transmitter in the activator switch 18 of a preferred embodiment has a range of up to 1000 feet, although other ranges are also possible. The activator switch 18 is therefore a self-contained unit which does not require external wiring, and is easy to install.

Upon activation of the activator switch button 28, the receiver 4 sounds and may flash or vibrate, alerting election officials in the polling facility 10 of the presence of a disabled voter who needs assistance. The activator switch 18 is mounted underneath the sign 14. The front of the activator switch 18 has the international symbol for handicapped accessibility along with text indicating that the person should ring for voting assistance. A separate sign 14A to be placed at the alternative entrance aB is also possible.

The reference guide 36 included with the kit may also include a form or information on accessibility grants available to election officials under the Help America Vote Act of 2002.

It is contemplated that the kit is sold as shown in FIG. 3 but that a companion portable ramp 6 may be available.

The present invention therefore provides an improvement that will allow polling places to become more accessible to voters with disabilities, as is required by federal law.

The materials included in the present kit enable election officials to control themselves the accessibility of the facilities used as polling places. The system allows all of the accessibility materials and improvements to be packed into a handy carrying case 38 and stored at election facilities along with other election equipment when it is not an election day. The carrying case 38 containing the components of the kit can be delivered on election day to election judges at each polling places and set up at that time to ensure accessibility. At the end of the election day, the components are packed up, put away in the case 38, and returned to storage until the next election.

This allows election officials to determine how to make their facilities accessible. If, for example, a polling place is moved, the kit can be moved in subsequent elections. Or if a polling place is made permanently accessible, the kit can be moved in subsequent elections to another polling location that needs to be made more accessible.

The solution is also much more affordable to election officials than permanent changes to polling places. It also does not require election officials to impose or force changes on landlords and owners of facilities that the election officials are only leasing for election days. It also avoids costly equipment like automatic door openers and other specialized products or renovation.

It is foreseen that the present kit will be provided by sale through direct sales from the company or election supply companies, in conjunction with consulting services, or through catalogs or other order facilities, including on-line ordering.

According to the invention, a method of providing access capability to a polling place or access to voting equipment is provided, as illustrated for example in FIG. 1. Election officials are made aware of disabled access issues by legislation and other requirements, etc. If action is deemed necessary, election officials may review their alternatives for meeting federal accessibility guidelines and decided to make a decision, to purchase equipment. If the decision is negative, the process is ended, but if the decision is positive then a set number of versions of the kit are purchased, depending on the number of inaccessible polling locations election officials seek to improve.

Once the system is purchased, election officials will need to determine which polling places require improvements to accessibility for election day. The system will be delivered on or before election day to those locations that require accessibility improvements, including those that may need portable ramps 6.

Election judges at those locations that have the system will review the installation instructions 36 and determine whether a ramp is needed and which of the four accessibility entry scenarios the kit will be used for. Election judges will then assemble the system by unzipping the carrying case 38, placing the activator switch 18 and mounting bracket 34 onto the telescoping pole 16, telescoping out the pole 16 to its full length, screwing the pole 16 into the base 20, attaching the sign 14 to the top of the bracket 34, placing the assembled system outside of the polling location 10 in a location where voters 5 approaching the polling place can activate it, placing the receiver unit 4 and plugging it in if necessary in a location that can be heard by election judges 3, and reviewing the materials 36 on accessibility. If a ramp 6 is to be used, election judges 3 are then trained in the set up and use of the ramp 6.

A voter 5 with a disability encountering the polling location 10 equipped for access using the present kit approaches the polling place 10, and determines if independent entry is possible. If so, the person enters independently.

If the disabled person is unable to enter unassisted, they recognize the sign 14 as indicating an accessible facility, follow the instructions to ring the activator switch 18 so that the receiver 4 inside the building 10 sounds and may light up. The election judge 3 is alerted, who then determines what type of assistance is needed.

If the voter 5 merely needs assistance with a heavy or inaccessible door 2A, the election judge 5 comes to the front and opens the door 2A for the voter 5 and escorts him or her to the voting area 12. After the voter 5 has voted, the election judge 3 may assist the voter 5 with egress from the facility 10.

If the facility 10 has an entrance 2 that is accessible but that cannot be easily accessed by the voter 5 with a disability, the voter 5 activates the switch 18 at the main voter entrance 2A, and the election judge 3 comes to the main voter entrance 2A. The election judge 3 then escorts the voter 5 to the accessible alternative entrance 2B and assists the voter 5 in any other way necessary.

If the facility 10 has short steps 2C at the entrance, a portable ramp 6 may be needed. The voter 5 with a disability rings the activator switch 18 at the main voter entrance, and the election judge 3 comes out to assist by putting down the portable ramp 6. If the ramp 6 is needed, it is installed, and assistance is offered, so that the disabled person 5 can enter. The ramp 6 should be removed if it interferes with the entry and exit of non-disabled persons. Once the voter 5 has voted the ramp 6, if needed, is put down and assistance is offered to exit the polling place 10. Once the disabled voter 5 has safely exited the facility 10, the ramp 6 is removed and the process is ended.

If the facility 10 has multiple steps 2D at the entry or within the facility and cannot be made accessible to the voter 5 with disabilities through a portable ramp 6 or other entry 2B, the system can be used to facilitate curbside voting 2D. In this process, the voter approaches the inaccessible facility 10 and activates the switch 18. An election judge 3 comes out to explain to the voter 5 that the facility is inaccessible and offers curbside voting. The election judge 3 brings a ballot, either in electronic or other form, out to the voter 5 outside of the facility 10 and the voter 5 proceeds to vote at that time.

Alternative embodiments for the present invention provide that the receiver 4 may include a battery option or an AC/battery alternative. If the polling place 10 is noisy, such as a restaurant, the receiver 4 may include the flashing light 32 to alert the election judges 3 that a voter 5 requires assistance.

Another alternative embodiment for the present invention may provide that an additional version of the system can be set up near a driveway or parking lot so that voters with disabilities who are unable to exit their vehicles can ring the alert system bell 18 for assistance and request curbside voting.

The sign 14, or an additional sign 14A, may be provided with the international symbol of accessibility or the logo of the county or election commission using the access equipment.

The present invention therefore permits election officials to increase access for voters with disabilities whether by allowing the voter to enter the polling place to cast a vote or by allowing the voter to specifically request assistance with voting so that a ballot can be brought to him or her for curbside voting.

Costs of consultants and contractors for special modifications as well as the problems of changing polling locations and finding new locations are avoided, and voters with disabilities have ensured that they will be able to vote at their present polling location on election day.

Although other modifications and changes may be suggested by those skilled in the art, it is the intention of the inventors to embody within the patent warranted hereon all changes and modifications as reasonably and properly come within the scope of their contribution to the art.

We claim:

1. A voting access kit, comprising:

a case for transport and storage of the voting access kit;

a sign designating a location as a disabled accessible voting location, said sign being stored in said case;

a collapsible post being stored in said case, said collapsible post constructed to be extended at a voting location and to receive said sign when in an extended position;

a base being stored in said case, said base constructed so as to be mounted with said collapsible post when said collapsible post is in the extended position to support said collapsible post at a voting location;

an activation switch being stored in said case; said activation switch constructed so as to be mounted on said collapsible post when said collapsible post is in the extended position, said activation switch including a transmitter for transmitting a signal when activated so as to indicate a request for access to a voting location;

a receiver being stored in said case, said receiver being constructed to receive said signal from said activation switch and to thereafter produce an alert; and instructions in said case for assembly and use of the kit, said instructions providing guidance for installation of said sign and said activation switch for use by disabled persons seeking to use a voting location.

2. A voting access kit as claimed in claim 1, wherein said receiver includes a loudspeaker operable to emit an audible signal upon receipt of the signal.

3. A voting access kit to assist polling facility staff in providing access to a polling facility by a disabled voter; comprising:

a case;

a collapsible stand being stored in said case;

an activation switch being stored in said case and adapted for mounting on said collapsible stand, said activation switch emitting a signal when operated such as to alert the polling facility staff to the presence of the disabled voter;

a sign being stored in said case, said sign indicating a location as an accessible polling location for disabled voters; and instructions in said case on assembly and use of the voting access kit at a voting location, said instructions guiding an installer in height and location preferences elements of the voting access kit for disabled access to the voting location.

4. A voting access kit as claimed in claim 3, wherein said activation switch emits a radio signal, and further comprising:

a receiver operable to receive the radio signal from said activation switch and generate an alert.

5. A voting access kit as claimed in claim 4, wherein said radio receiver is constructed to generate an audio alert upon receiving the radio signal.

6. A method for providing access to voting locations for disabled persons, comprising the steps of:

providing a portable kit for use at a voting location during voting, said kit including: a case, said case enclosing a collapsible stand, and an activation switch that is selectively mountable on said collapsible stand, said activation switch being operable to active at least one of a light and an audible alarm of such intensity as to alert others of a need for assistance by a disabled person; and instructing polling place staff on use of the portable kit, said step of instructing including instructing the staff as to location and height for mounting the collapsible stand and for mounting the activation switch on the collapsible stand and instructing the staff for responding to said at least one of the light and the audible alarm.

7. A method as claimed in claim 6, further comprising:

providing a portable ramp as an option for said portable kit.

* * * * *